US005504291A

United States Patent [19]

Goble et al.

[11] Patent Number: 5,504,291

[45] Date of Patent: Apr. 2, 1996

[54] CONTACT BLADE ASSEMBLY FOR A CIRCUIT BREAKER

[75] Inventors: Christopher K. Goble, Marion; Joel L. Miller, Cedar Rapids, both of Iowa

[73] Assignee: Square D Company, Palatine, Ill.

[21] Appl. No.: 194,680

[22] Filed: Feb. 14, 1994

[51] Int. Cl.[6] ..... H01H 5/08

[52] U.S. Cl. ..... 200/465; 200/272

[58] Field of Search ..... 200/245, 246, 200/250, 271, 272, 273, 274, 290, 401, 465; 325/174, 23, 16, 22, 14, 26, 35, 189, 191

[56] References Cited

U.S. PATENT DOCUMENTS

| | | | |
|---|---|---|---|
| 1,850,703 | 3/1932 | Angold | 200/272 X |
| 1,991,113 | 2/1935 | Nette | 200/465 |
| 1,999,880 | 4/1935 | Leonard | 200/465 |
| 2,060,481 | 11/1936 | Austin | 200/272 X |
| 2,979,592 | 4/1961 | Watson | 200/290 |
| 3,196,240 | 7/1965 | Latour | 200/272 X |
| 3,264,442 | 8/1966 | Holzer | 200/290 X |
| 3,806,848 | 4/1974 | Harper et al. | 335/191 X |
| 3,943,316 | 3/1976 | Oster | 200/337 |
| 3,943,472 | 3/1976 | Oster et al. | 335/16 |
| 3,944,953 | 3/1976 | Oster | 335/23 |
| 3,946,346 | 3/1976 | Oster et al. | 335/16 |
| 4,417,223 | 11/1983 | Bancalari | 335/195 |
| 4,739,291 | 4/1988 | Lee | 335/191 X |
| 4,740,768 | 4/1988 | Morris et al. | 335/22 |
| 5,003,139 | 3/1991 | Edds et al. | 200/401 |
| 5,073,764 | 12/1991 | Takahashi et al. | 335/16 |
| 5,075,657 | 12/1991 | Rezac et al. | 335/6 |
| 5,097,589 | 3/1992 | Rezac et al. | 29/622 |
| 5,159,304 | 10/1992 | Yamagata et al. | 335/202 |
| 5,245,302 | 9/1993 | Brune et al. | 335/35 |

FOREIGN PATENT DOCUMENTS

| | | | |
|---|---|---|---|
| 1232636 | 10/1960 | France . | |
| 1248519 | 11/1960 | France | 200/271 |
| 4222965 | 11/1993 | Germany . | |
| 298960 | 7/1932 | Italy | 335/191 |

*Primary Examiner*—Renee S. Luebke

*Attorney, Agent, or Firm*—Larry I. Golden; Kareem M. Irfan; Wayne H. Stoppelmoor

[57] ABSTRACT

A contact blade assembly for a circuit breaker comprises a blade carrier, an elongated blade, and a toggle spring. The blade carrier includes a blade pivot and a first spring pivot. The elongated blade has an electrical contact mounted thereto and includes a second spring pivot. The blade is rotatably mounted to the blade pivot of the blade carrier for rotation between a closed position and an open position. The toggle spring is connected to the first spring pivot at one end and to the second spring pivot at the other end. The first spring pivot, the second spring pivot, and the blade pivot are arranged such that a toggle condition associated with the rotation of the blade relative to the blade carrier corresponds to the blade pivot being located in line and between the first and second spring pivots. The toggle spring biases the blade away from the toggle condition in a first direction while the blade is disposed in the closed position. The toggle spring biases the blade away from the toggle condition in a second direction opposite the first direction while the blade is disposed in the open position.

11 Claims, 1 Drawing Sheet

('ON' POSITION)

("ON" POSITION)

("OFF" POSITION)

("BLOWN OPEN" POSITION)

CONTACT BLADE ASSEMBLY FOR A CIRCUIT BREAKER

FIELD OF THE INVENTION

The present invention relates generally to circuit breakers and, more particularly, to a contact blade assembly for a circuit breaker.

BACKGROUND OF THE INVENTION

Circuit breakers are commonly used for providing automatic circuit interruption upon detection of undesired overcurrent conditions on the circuit being monitored. These overcurrent conditions include, among others, overload conditions, ground faults and short-circuit conditions.

Circuit breakers typically include an electrical contact on a movable blade which rotates away from a stationary contact in order to interrupt the current path. The blade is pivotally mounted to a rotatable blade carrier, and a spring is used to bias the movable contact toward the stationary contact during normal current conditions. The type of overcurrent condition dictates how quickly the blade must rotate away from the stationary contact. For example, in response to overcurrent conditions at relatively low magnitudes but present for a long period of time, circuit breakers generally employ a tripping mechanism to rotate the blade carrier carrying the blade. Since the blade rotates with the blade carrier, the contact on the blade is forced away from the stationary contact. In response to overcurrent conditions at relatively high magnitudes, circuit breakers must break (or blow-open) the current path very quickly, reacting must faster than the reaction time for the tripping mechanism. In this case, the blade rotates to an open position prior to actuation of the tripping mechanism. The blade is maintained in the open position using a mechanism such as a blade catcher.

A drawback of the foregoing contact blade assembly is that in order to catch and maintain the blade in this open position, the circuit breaker requires a mechanism which is separate from the blade and the contact force-producing spring. It is difficult to properly coordinate the operation of this separate mechanism with the movement of the blade to successfully catch and maintain the blade in the open position. In addition, this separate mechanism increases the cost and complexity of the circuit breaker.

Accordingly, there is a need for a contact blade assembly for a circuit breaker which can be implemented without the aforementioned shortcomings.

SUMMARY OF THE INVENTION

The present invention provides a contact blade assembly which maintains the blade in the blown-open position by virtue of over-toggle action associated with a contact force-producing spring. Thus, the present invention avoids the use of a separate mechanism for maintaining the blade in the blown-open position.

In one particular embodiment, the foregoing objects are realized by providing a contact blade assembly for a circuit breaker, comprising a blade carrier, an elongated blade, and a toggle spring. The blade carrier includes a blade pivot and a first spring pivot. The elongated blade has an electrical contact mounted thereto and includes a second spring pivot. The blade is rotatably mounted to the blade pivot of the blade carrier for rotation between a closed position and an open position. The toggle spring is connected to the first spring pivot at one end and to the second spring pivot at the other end. The first spring pivot, the second spring pivot, and the blade pivot are arranged such that a toggle condition associated with the rotation of the blade relative to the blade carrier corresponds to the blade pivot being located in line and between the first and second spring pivots. The toggle spring biases the blade away from the toggle condition in a first direction while the blade is disposed in the closed position. The toggle spring biases the blade away from the toggle condition in a second direction opposite the first direction while the blade is disposed in the open position.

The above summary of the present invention is not intended to represent each embodiment, or every aspect, of the present invention. This is the purpose of the figures and the detailed description which follow.

BRIEF DESCRIPTION OF THE DRAWINGS

Other objects and advantages of the invention will become apparent upon reading the following detailed description and upon reference to the drawings in which.

Figure 1:
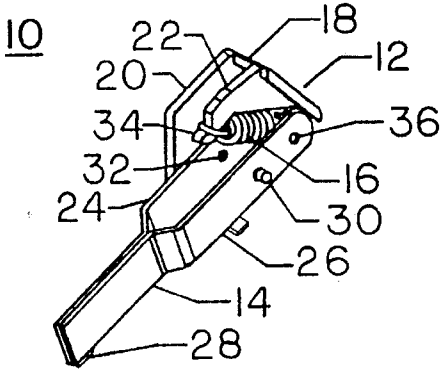
FIG. 1 is a perspective view of a contact blade assembly embodying the present invention.

While the invention is susceptible to various modifications and alternative forms, specific embodiments thereof have been shown by way of example in the drawings and will be described in detail. It should be understood, however, that it is not intended to limit the invention to the particular form described. On the contrary, the intention is to cover all modifications, equivalents, and alternatives falling within the spirit and scope of the invention as defined by the appended claims.

DETAILED DESCRIPTION OF THE PREFERRED EMBODIMENT

Figure 2:
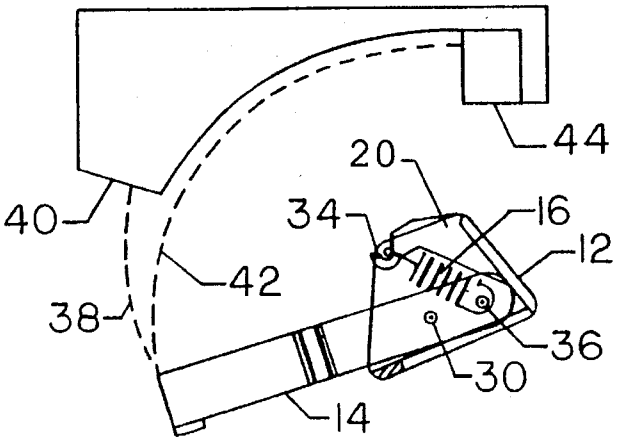
FIG. 2 is a side view of the contact blade assembly in FIG. 1 showing the assembly in the closed (or "on") position.

Turning now to the drawings, FIG. 1 illustrates a contact blade assembly 10 including a metal blade carrier 12, an elongated metal blade 14, and a toggle spring 16. The blade carrier 12 includes a back plate 18, a pair of parallel side plates 20 (only one shown in FIG. 1), and a center plate 22 positioned halfway between the pair of side plates 20. The side plates 20 are preferably trapezoidal in shape (see FIGS. 2–4) and the center plate 22 is sized and configured to accommodate the toggle spring 16.

The blade 14 is configured in the shape of a two-pronged fork and is formed from a pair of identically-shaped metal strips 24, 26. These metal strips 24, 26 are attached together by means such as welding. An electrical contact 28 is mounted to one end of the blade 14. A pair of pivot pins 30 are rigidly mounted to the other end of the blade 14 for pivotally mounting the blade 14 to the blade carrier 12. In particular, one of the pivot pins 30 is attached to the strip 26 of the blade 14 and extends into an aperture in the strip 26 and a corresponding aperture in the adjacent side plate 20 of the blade carrier 12. Similarly, the other of the pivot pins 30 is attached to the strip 24 of the blade 14 and extends into an aperture 32 in the strip 24 and a corresponding aperture (not shown) in the second side plate 20 of the blade carrier 12. The extension of these pivot pins 30 into the side plates 20 of the blade carrier 12 permits the blade 14 to rotate relative to the blade carrier 12 between the "on" position in FIG. 2 and the "blown open" position in FIG. 4.

To bias the blade 14 in either the "on" position or the "blown open" position relative to the blade carrier 12, the blade carrier 12 and the blade 14 are provided with respective spring pivots 34, 36 for securing opposite ends of the toggle spring 16. The spring pivot 34 is a notch formed in the center plate 22 of the blade carrier 12, and the spring pivot 36 is a pin extending between the strips 24, 26 of the blade 14. With respect to the blade end adjacent the back plate 18 of the blade carrier 12, the spring pivot 36 is located closer to the blade end than the pivot pins 30.

To permit the toggle spring 16 to bias the blade 14 in two separate positions, the geometric relationship between the blade pivot pins 30 and the spring pivots 34, 36 is such that the spring pivot 36 is positioned farther from the spring pivot 34 than from the blade pivot pins 30. In the "on" position (FIG. 2), the toggle spring 16 is rotationally located above the blade pivot pins 30. The toggle spring 16 is disposed in a slightly stretched form so as to bias the blade 14 away from the toggle spring 16. The blade carrier 12 is rotationally positioned such that the movable blade contact 28 is maintained against an opposing stationary contact (not shown) mounted to a line terminal.

In response to overcurrent conditions at relatively low magnitudes but present for a long period of time, a tripping mechanism (not shown) rotates the entire blade carrier 12 clockwise (as viewed in FIG. 3) to an "off" position. As the blade carrier 12 rotates from the "on" position (FIG. 2) to the "off" position (FIG. 3), the blade 14 rotates therewith because the toggle spring 16 maintains the blade 14 against a floor of the blade carrier 12. Therefore, the relative locations of the toggle spring 16 and the blade pivot pins 30 do not change. The blade carrier 12 is provided with the floor only at its lower front section (i.e., lower left section as viewed in FIGS. 2–4). The floor is formed by a narrow strip or bar of metal oriented perpendicular to the blade 14 and extending between the lower front edges of the side plates 20 of the blade carrier 12. As viewed in FIG. 4, this floor is located to the left of the blade 14. While the blade carrier 12 moves from the "on" position in FIG. 2 to the "off" position in FIG. 3 in response to a low-level current fault, the floor supports the lower edge of a central section of the blade 14 to carry the blade 14 with the carrier 12. In moving from the "on" position to the "off" position, the contact end of the blade 14 follows the rotational path designated by the reference numeral 38. The tripping mechanism rotates the blade carrier 12 by such a distance that the contact end of the blade 14 strikes a first blade stop 40. Since the blade 14 rotates with the blade carrier 12, the contact 28 on the blade 14 is forced away from the stationary contact. The blade assembly 10 is reset to the "on" position by resetting the tripping mechanism.

Figure 4:
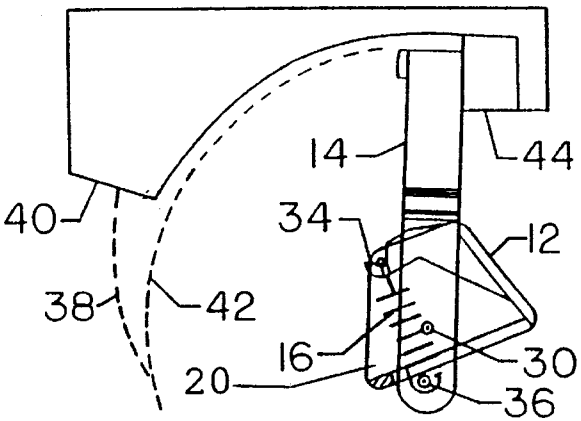
FIG. 4 is a side view of the contact blade assembly in FIG. 1 showing the assembly in the "blown open" position.

In response to overcurrent conditions at relatively high magnitudes, i.e., a short-circuit, repulsive electromagnetic forces between the blade 14 and the line terminal push the blade 14 away from the line terminal. These forces rotate the blade 14 from the "on" position (FIG. 2) to the "blown open" position (FIG. 4) prior to actuation of the circuit breaker tripping mechanism. While the blade 14 rotates from the "on" position to the "blown open" position, the spring pivot 36 rotates about the blade pivot pins 30, which, in turn, causes the toggle spring 16 to rotate clockwise about the spring pivot 34 (as viewed in FIGS. 2 and 4) and to change in length. As the blade 14 initially rotates from the "on" position, the radial distance between the spring pivots 34, 36 increases, thereby stretching the toggle spring 16. The toggle spring 16 continues to stretch until the spring pivots 34, 36 and the blade pivot pins 30 are all in line with one another. Further rotation of the blade 14 decreases the radial distance between the spring pivots 34, 36, which slightly reduces but does not eliminate the stress in the toggle spring 16 (FIG. 4). The blown-open blade 14 follows the path designated by the reference numeral 42. A second blade stop 44 is used to halt the rotating blade 14 in the position illustrated in FIG. 4.

In the "blown open" position, the toggle spring 16 is rotationally located on the opposite side of the pivot pins 30 relative to the "on" position. This over-toggle condition maintains the blade 14 in the "blown open" position, thereby preventing re-establishment of current flow in the circuit into which the blade assembly is installed.

Figure 3:
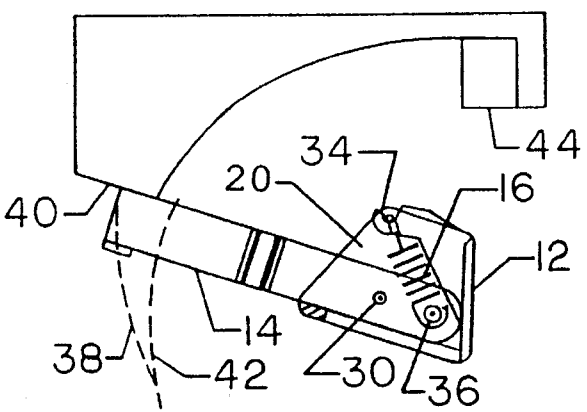
FIG. 3 is a side view of the contact blade assembly in FIG. 1 showing the assembly in the tripped (or "off") position.

Due to the slow reaction time of the circuit breaker tripping mechanism, the tripping mechanism does not trip until after the blade assembly 10 is in the "blown open" position of FIG. 4. This tripping of the tripping mechanism, however, rotates the blade carrier 12 clockwise relative to the blade 14. This, in turn, rotates the toggle spring 16 clockwise about the spring pin 36 so as to move the toggle spring 16 from the over-toggle side of the pivot pins 30 to the other side of pivot pins 30. This forces the blade assembly 10 into the "off" position in FIG. 3. When the blade rotates from the "blown open" position in FIG. 4 to the "off" position in FIG. 3, the contact end of the blade 14 presses against the curved surface bridging the stops 40 and 44. However, the torque causing the blade 14 to move from the "blown open" position in FIG. 4 to the "off" position in FIG. 3 is sufficient to overcome the frictional force caused by the blade 14 pressing against this curved surface. Thus, the contact end of the blade 14 essentially slides along the curved surface until the blade 14 reaches the blade stop 40, at which point the blade 14 slides off the curved surface and onto the flat surface of the blade stop 40. The blade assembly 10 is then reset to the "on" position by resetting the tripping mechanism.

While the present invention has been described with reference to one or more particular embodiments, those skilled in the art will recognize that many changes may be made thereto without departing from the spirit and scope of the present invention. Each of these embodiments and obvious variations thereof is contemplated as falling within the spirit and scope of the claimed invention, which is set forth in the following claims.

What is claimed is:

1. A contact blade assembly for a circuit breaker, comprising:

a blade carrier including a blade pivot and a first spring pivot;

an elongated blade having an electrical contact mounted thereto and having a second spring pivot, the distance between said second spring pivot and said electrical contact being greater than the distance between said first spring pivot and said electrical contact, said blade rotatably mounted to said blade pivot of said blade carrier for rotation from a closed position to an open position in response to an overcurrent condition in the circuit breaker; and a toggle spring connected to said first spring pivot at one end and to said second spring pivot at the other end, said first spring pivot, said second spring pivot, and said blade pivot being arranged such that a toggle condition associated with the rotation of said blade relative to said blade carrier corresponds to said blade pivot being located in line and between said first and second spring pivots, said toggle spring biasing said blade away from said toggle condition in a first direction while said blade is disposed in said closed position, said toggle spring biasing said blade away from said toggle condition in a second direction opposite said first direction while said blade is disposed in said open position, said blade pivot and said first spring pivot being stationary as said blade passes through said toggle condition while said blade rotates from said closed position to said open position, said second spring pivot rotating about said stationary first spring pivot to cause said blade to pass through said toggle condition while said blade rotates from said closed position to said open position, wherein said second spring pivot rotates relative to said first spring pivot such that the position of said blade pivot is located between said first and second spring pivots as said blade rotates through said toggle condition.

2. The contact blade assembly of claim 1, wherein the linear distance between said blade pivot and said first spring pivot is less than the linear distance between said first and second spring pivots as said blade rotates from said closed position to said open position.

3. The contact blade assembly of claim 2, wherein the linear distance between said first and second spring pivots is a maximum at said toggle condition such that the linear distance between said first and second spring pivots increases while said blade rotates from said closed position to said toggle condition and such that the linear distance between said first and second spring pivots decreases while said blade rotates from said toggle condition to said open position.

4. The contact assembly of claim 1, wherein in response to said blade rotating relative to said blade carrier, said second spring pivot rotates about said blade pivot such that said toggle spring simultaneously moves rotationally and radially relative to said first spring pivot.

5. The contact assembly of claim 4, wherein the linear distance between said blade pivot and said first spring pivot is less than the linear distance between said first and second spring pivots as said blade rotates from said closed position to said open position.

6. The contact assembly of claim 1, wherein said toggle spring biases said blade against a blade stop while said blade is disposed in said open position.

7. The contact assembly of claim 1, wherein said blade carrier is rotatable in a same rotational direction as said blade, and wherein in response to rotation of said blade carrier while said blade is disposed in said open position, said blade passes through said toggle condition such that said toggle spring biases said blade in said first direction.

8. A contact blade assembly for a circuit breaker, comprising:

a blade carrier including a blade pivot and a first spring pivot;

an elongated blade having an electrical contact mounted thereto and having a second spring pivot, the distance between said second spring pivot and said electrical contact being greater than the distance between said first spring pivot and said electrical contact, said blade rotatably mounted to said blade pivot of said blade carrier for rotation between a closed position and first and second open positions, said blade rotating from said closed position to said first open position in response to a first overcurrent condition in the circuit breaker, said blade rotating from said closed position to said second open position in response to a second overcurrent condition in the circuit breaker, the magnitude of current associated with said first overcurrent condition being greater than the magnitude of current associated with said second overcurrent condition; and a toggle spring connected to said first spring pivot at one end and to said second spring pivot at the other end, said first spring pivot, said second spring pivot, and said blade pivot being arranged such that a toggle position of said blade relative to said blade carrier corresponds to said blade pivot being located in line and between said first and second spring pivots, said toggle position being disposed between said closed position and said open position of said blade, said toggle spring biasing said blade away from said toggle position and toward said closed position while said blade is disposed between said toggle position and said closed position, said toggle spring biasing said blade away from said toggle position and toward said open position while said blade is disposed between said toggle position and said open position, said blade passing through said toggle position while rotating from said closed position to said first open position in response to said first overcurrent condition, said blade not passing through said toggle position while rotating from said closed position to said second open position in response to said second overcurrent condition, wherein said second spring pivot rotates such that the position of said blade pivot is located between said first and second spring pivots as said blade rotates through said toggle position.

9. The contact blade assembly of claim 8, wherein the rotational distance between said first open position and said closed position is greater than the rotational distance between said second open position and said closed position, said blade rotating from said first open position to said second open position after rotating from said closed position to said first open position, said blade passing through said toggle position while rotating from said first open position to said second open position.

10. A contact blade assembly for a circuit breaker, comprising:

a blade carrier including a blade pivot and a first spring pivot;

an elongated blade having an electrical contact mounted thereto and having a second spring pivot, the distance between said second spring pivot and said electrical contact being greater than the distance between said first spring pivot and said electrical contact, said blade rotatably mounted to said blade pivot of said blade carrier for rotation from a closed position to an open position in response to an overcurrent condition in the circuit breaker; and a toggle spring connected to said first spring pivot at one end and to said second spring pivot at the other end, said first spring pivot, said second spring pivot, and said blade pivot being arranged such that a toggle condition associated with the rotation of said blade relative to said blade carrier corresponds to said blade pivot being located in line and between said first and second spring pivots, said toggle spring biasing said blade away from said toggle condition in a first direction while said blade is disposed in said closed position, said toggle spring biasing said blade away from said toggle condition in a second direction opposite said first direction while said blade is disposed in said open position, wherein the linear distance between said blade pivot and said first spring pivot is less than the linear distance between said first and second spring pivots as said blade rotates from said closed position to said open position, wherein the linear distance between said first and second spring pivots is a maximum at said toggle condition such that the linear distance between said first and second spring pivots increases while said blade rotates from said closed position to said toggle condition and such that the linear distance between said first and second spring pivots decreases while said blade rotates from said toggle condition to said open position.

11. A contact blade assembly for a circuit breaker, comprising:

a blade carrier including a blade pivot and a first spring pivot;

an elongated blade having an electrical contact mounted thereto and having a second spring pivot, said blade rotatably mounted to said blade pivot of said blade carrier for rotation between a closed position and first and second open positions, said blade rotating from said closed position to said first open position in response to a first overcurrent condition in the circuit breaker, said blade rotating from said closed position to said second open position in response to a second overcurrent condition in the circuit breaker, the magnitude of current associated with said first overcurrent condition being greater than the magnitude of current associated with said second overcurrent condition; and a toggle spring connected to said first spring pivot at one end and to said second spring pivot at the other end, said first spring pivot, said second spring pivot, and said blade pivot being arranged such that a toggle condition associated with the rotation of said blade relative to said blade carrier corresponds to said blade pivot being located in line and between said first and second spring pivots, said toggle spring biasing said blade away from said toggle condition in a first direction while said blade is disposed in said closed position, said toggle spring biasing said blade away from said toggle condition in a second direction opposite said first direction while said blade is disposed in said open position;

wherein as said blade rotates from said closed position to said first open position, said blade pivot and said first spring pivot are stationary and said second spring pivot rotates about said stationary first spring pivot to cause said blade to pass through said toggle condition;

wherein the rotational distance between said first open position and said closed position is greater than the rotational distance between said second open position and said closed position, said blade rotating from said first open position to said second open position after rotating from said closed position to said first open position; and wherein as said blade rotates from said first open position to said second open position, said first spring pivot rotates about said second spring pivot to cause said blade to pass through said toggle condition.

* * * * *